United States Patent [19]

Ando et al.

[11] 4,248,951

[45] Feb. 3, 1981

[54] METHOD OF IMAGE FORMATION WITH A SCREEN ELEMENT AND CHARGING MEANS

[75] Inventors: Yujiro Ando, Yokohama; Katsunobu Ohara, Kawasaki, both of Japan

[73] Assignees: Canon Kabushiki Kaisha, Tokyo, Japan; Canon Kabushiki Kaisha, Tokyo, Japan

[21] Appl. No.: 9,590

[22] Filed: Feb. 5, 1979

Related U.S. Application Data

[63] Continuation of Ser. No. 750,568, Dec. 14, 1976, abandoned.

[30] Foreign Application Priority Data

Dec. 22, 1975 [JP] Japan ..... 50-153117

[51] Int. Cl.[3] ..... G03G 13/22

[52] U.S. Cl. ..... 430/53; 430/68; 355/3 SC

[58] Field of Search ..... 96/1 R, 1.4; 355/3 SC; 430/53, 68

[56] References Cited

U.S. PATENT DOCUMENTS

| | | | |
|---|---|---|---|
| 2,752,271 | 6/1956 | Walkup et al. | 96/1 R |
| 3,363,555 | 1/1968 | Olden | 96/1.4 X |
| 3,940,270 | 2/1976 | Krulik | 96/1.4 |
| 3,942,980 | 3/1976 | Hou | 96/1 R |
| 3,976,484 | 8/1976 | Ando et al. | 96/1 R |

*Primary Examiner*—Mayer Weinblatt
*Assistant Examiner*—John L. Goodrow
*Attorney, Agent, or Firm*—Fitzpatrick, Cella, Harper & Scinto; Fitzpatrick, Cella, Harper & Scinto

[57] ABSTRACT

In a method of image formation, a primary electrostatic latent image is formed on a screen having a number of fine openings, the primary electrostatic latent image is used to modulate a flow of ions to thereby form a secondary electrostatic latent image on a recording medium, the secondary electrostatic latent image is developed by the use of a developer, the developed image is transferred to another recording member, the charging polarity of the residual portion of the developer remaining on the recording medium is controlled so that, at a position whereat the recording medium and the screen come close to each other, the residual developer may be subjected to a force directed toward the recording medium by an electric field present between the recording medium and the screen, and thereafter the recording medium is reused.

15 Claims, 9 Drawing Figures

METHOD OF IMAGE FORMATION WITH A SCREEN ELEMENT AND CHARGING MEANS

This is a continuation of application Ser. No. 750,568 filed Dec. 14, 1976, now abandoned.

BACKGROUND OF THE INVENTION

1. Field of the Invention

This invention relates to a method of image formation using a photosensitive screen having a number of fine openings (hereinafter simply referred to as the screen), and more particularly to a method of forming images by modulating a flow of ions several times by the use of one and the same primary electrostatic latent image.

2. Description of the Prior Art

As a typical technique of image formation using the conventional electrophotography, there may be mentioned the direct method such as the electrofax method whereby a developed photosensitive member is directly used as a finished copy, or the indirect method such as the xerography whereby a photosensitive member is used as an intermediate recording medium and the developed image on such photosensitive member is transferred to a transfer medium which is used as the finished copy. Of these two methods, the former, namely, the direct method of image formation employs, as the photosensitive member, a recording member subjected to a special treatment such as coating with a photoconductive substance such as zinc oxide or the like, which causes a decreased brightness and a problem regarding the contrast of the image. Also, said treatment has led to a disadvantage that the recording member gives a somewhat different sense of touch and of weight from those of common plain paper. On the other hand, in the latter method, namely, the indirect method of image formation, image is formed by using plain paper as the transfer medium and this leads to a merit that the resultant copy image is of high contrast and good quality. Nevertheless, with this indirect method, the recording member is brought into contact with the surface of the photosensitive medium during the transfer of toner image to the recording member and further, after the image transfer, the surface of the photosensitive medium is again strongly contacted by cleaning means such as a brush or elastic blade for the purpose of removing any residual toner on the photosensitive medium, so that the surface of the photosensitive medium may gradually become damaged each time it is contacted. This limits the service life of the expensive photosensitive medium, which may also result in higher cost of image formation.

These disadvantages peculiar to the above-described conventional electrophotography are eliminated by the electrophotographic method as disclosed in U.S. Pat. No. 3,713,734. Such electrophotographic method uses a photosensitive screen in the form of a netting or lattice having numberless fine mesh-like openings. Generally described, this method uses the above-mentioned screen, modulates a flow of ions into a form of image through the screen to thereby form an electrostatic latent image on the recording member, and thereafter develops this electrostatic latent image formed on the recording member. That is, this electrophotographic method need not develop and clean the screen which corresponds to the conventionally used photosensistive medium. Thus, the screen itself is never damaged during the image formation and such method is advantageous in that the screen can enjoy a long service life.

Particularly, the method disclosed in our U.S. Application Ser. No. 480,280 has been successful in improving the durability of the screen and utilizing a once formed primary electrostatic latent image more repetitively than before to form images (hereinafter referred to as retention copying). Herein, this method covered by our above-mentioned application need not be described in detail but will only generally be described below. First, the screen is constructed by covering an electrically conductive member, which is a substrate, with a photoconductive member and then with an insulating member, in such a manner that the conductive member is exposed at one side surface thereof. Image formation is effected thus: a primary electrostatic latent image is formed on the screen and this primary latent image is used to modulate an ion flow applied to a chargeable member, thereby providing a secondary electrostatic latent image on the chargeable member. As the chargeable member, use may be made of either electrostatic recording paper or a recording medium in the form of a drum (insulating drum) having an insulating layer which is less expensive than that of the conventional photosensitive medium. Where the electrostatic recording paper is used, it is directly developed and fixed by well-known means for utilization. In contrast, where the insulating drum is used, the secondary electrostatic latent image formed on the drum is one developed, and then transferred to another recording member such as plain paper or the like, whereafter the latter is fixed for utilization. Thus, the insulating drum can be rendered available for repetitive use by removing residual toner therefrom after the image transfer and moreover, the resin material forming the insulating layer has excellent wear-proof durability chacteristics.

When the insulating drum is used as described, a voltage must be applied between the screen and the recording member to attract the modulated ion flow toward the insulating drum so that the ion flow may be directed to the insulating drum side. However, the residual toner, remaining on the insulating drum after the image transfer, is attracted toward the screen due to the electric field induced by said voltage application which is acting adjacent to the screen and between the screen and the insulating drum. Of course, most of such residual toner on the insulating drum is removed by cleaning means after the image transfer, but a slight quantity of the residual toner which failed to be removed by the cleaning means goes to stick to the screen which is provided with no cleaning means. With lapse of time, the quantity of the toner sticking to the screen increases and as the result, the screen suffers from a reduced insulating property of the portion thereof which should provide electrical insulation, and/or the openings of the screen become clogged, thus rendering good modulation of ions impossible. This phenomenon will be more fully considered in connection with an example of the conventional apparatus which will hereinafter be described.

SUMMARY OF THE INVENTION

It is an object of the present invention to present a method of image formation which is carried out with the screen prevented from being contaminated by particles such as toner particles or paper powder present on the recording medium.

It is another object of the present invention to present a method of image formation which is carried out with the screen prevented from being contaminated by a slight quantity of developer such as toner or the like present on an insulated drum a recording medium as described above.

It is still another object of the present invention to sharply increase the number of times the screen modulates ion flows, by preventing the screen from becoming contaminated by the developer.

It is yet still another object of the present invention to enable modulation of ion flows to occur stably for a long time by preventing said contamination.

To achieve these objects, the present invention modulates ion flows with a primary electrostatic latent image formed on the screen to form a secondary electrostatic latent image on the recording medium; develops the secondary latent image by the use of a developer and transfers the developed image to another recording member, thereafter changes the charge of the residual portion of the developer remaining on the recording medium into a charge of such sense that it is subjected to a force directed toward the recording medium, by the electric field between the screen and the recording medium, at a position whereat the screen and the recording medium come close to each other; and thereby charges the residual developer to a polarity of such sense that the developer is subjected to the force directed toward the recording medium, thus rendering the recording medium ready for reuse. For example, after the image transfer or after the cleaning, the charging polarity of the residual toner remaining on the recording medium is changed into such a polarity that the developer is subjected to a force directed toward the recording medium, by the electric field between the screen and the recording medium. By this, the residual developer on the recording medium never drifts to stick to the screen even when such developer approaches the screen with the movement of the recording medium. Also, the present invention will particularly be effective if the charging of the developer to a predetermined potential is effected not by simply charging the developer to the predetermined potential but by repeating corona discharge a plurality of times to charge the developer to the predetermined potential. Why such charging method is effective to prevent the drift of the developer at the screen station will further be described in connection with the embodiments of the invention. Further, the present invention sets the polarity of the residual toner on the recording medium and the polarity of the developer in the developing means such that they are opposite to each other, thereby enabling the recording medium to become ready for reuse without it being cleaned to remove the residual toner therefrom. The invention will become more fully apparent from the following detailed description of some embodiments thereof taken in conjunction with the accompanying drawings.

DESCRIPTION OF THE PREFERRED EMBODIMENTS

Figure 1:
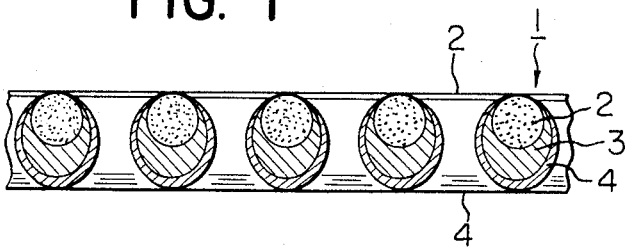
FIG. 1 is an enlarged cross-sectional view of an embodiment of the screen for illustrating the present invention.

Referring to FIG. 1, an embodiment of the photosensitive screen is schematically shown in enlarged cross-section to illustrate the construction thereof. The screen 1 comprises an electrically conductive member 2 such as metal netting or the like having a number of fine openings and a photoconductive member 3 and an insulating surface member 4 successively layered over the conductive member 2 so that the conductive member is exposed at one side surface thereof.

FIGS. 2 to 5 illustrate an example of the process for forming a latent image by the use of the screen 1. Details of such process are disclosed in our aforementioned U.S. Application Ser. No. 480,280 and need not further be described herein. However, a description will be made by taking as an example a case where use is made of a photosensitive screen having such a characteristic that positive pores are introduced in the photoconductive member of the screen 1. In other words, it is supposed that the photoconductive member 3 of the screen used is a semiconductor comprising Se or its alloy having positive pores as main carrier.

Figure 2:
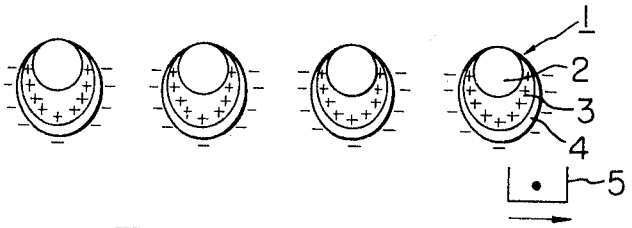
FIGS. 2 to 4 illustrate the process of forming a primary electrostatic latent image by the use of the screen of FIG. 1.

FIG. 2 shows the result of the step of applying a primary voltage. In this step, the insulating member of the screen 1 is uniformly charged to the negative polarity (−) by well-known charging means. By this charging, positive pores are introduced through the conductive member 2 into the photoconductive member 3 and captured in the interface adjacent to the insulating member 4. Designated by 5 is a corona discharger used for such charging.

Figure 3:
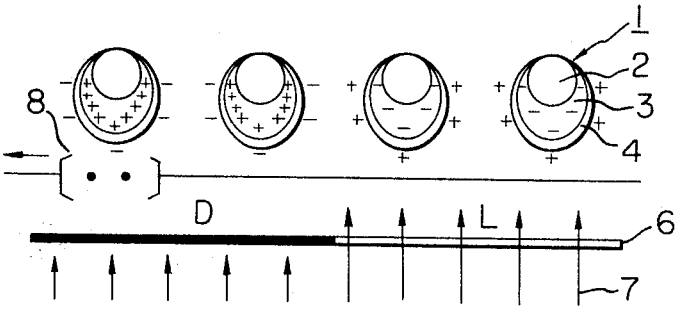

FIG. 3 shows the result obtained by carrying out the step of applying a secondary voltage and the step of applying image light substantially simultaneously. The secondary voltage applied is a corona discharge from a voltage source using an AC voltage with a bias voltage of the positive polarity superimposed thereon. The secondary voltage applied is not restricted to AC voltage, but a DC voltage opposite in polarity to the primary voltage may also be used. Also, where the dark attenuation characteristic of the photoconductive member 3 is slow, the application of the secondary voltage and the application of the image light need not always take place simultaneously but may occur successively. In FIG. 3, reference character 6 designates an image original, L a light region, D a dark region, 7 light rays, and 8 a corona discharger used for the application of the above-described secondary voltage.

Figure 4:
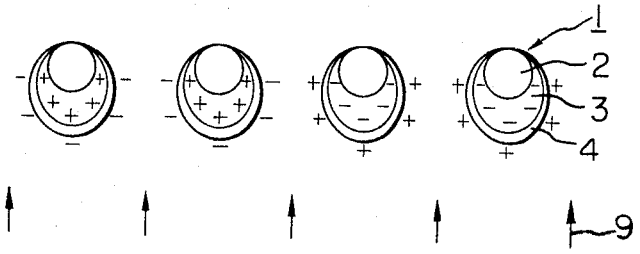

FIG. 4 shows the result of the whole surface illumination effected on the screen 1. As seen there, the surface potential of the screen 1 only in the dark region rapidly charges to a potential proportional to the quantity of surface charge on the insulating member 4, thereby forming a primary electrostatic latent image. Designated by 9 are light rays.

Figure 5:
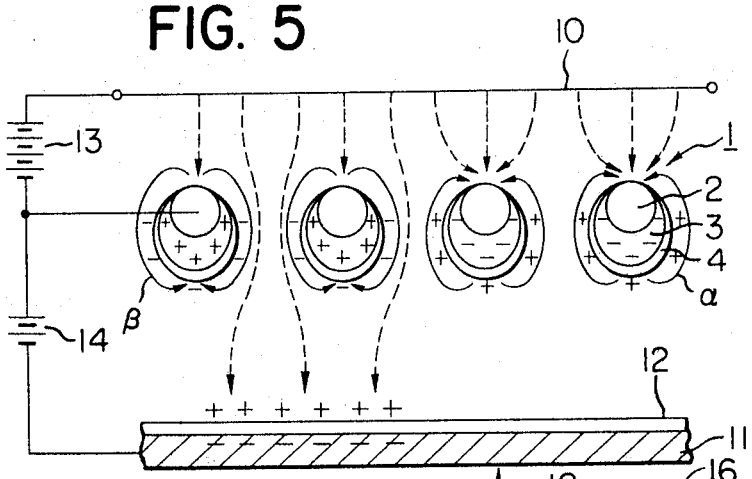
FIG. 5 illustrates the process of forming a secondary electrostatic latent image by the use of the same screen.

FIG. 5 shows the manner in which ion flows are modulated by the primary electrostatic latent image to form a positive image of the image original on a recording medium. Reference character 10 designates the corona wire of the discharger, and 15 denotes the recording medium which comprises an insulating layer 12 retaining charges thereon and a conductive back-up member 11 serving as the opposed electrode with respect to the corona wire 10. Designated by 13 and 14 is a power source section for forming ion flows between the wire 10 and the back-up member 11. The recording medium 15 is disposed adjacent to that side of the screen 1 which is occupied by the insulating member 4, and the ion flows from the corona wire 10 located at the opposite side of the screen 1 are applied to the recording medium 12 by utilization of the potential difference between the wire 10 and the conductive back-up member 11. When this occurs, the charge of the primary electrostatic latent image on the screen 1 causes electric fields indicated by solid lines $\alpha$ which act to block any flow of ions in the light region, and electric fields indicated by solid lines $\beta$which act to pass the ion flow in the dark region. By this, a secondary electrostatic latent image which is a positive image of the original is formed on the recording medium 15. When the screen 1 of the above-described construction is employed, the primary electrostatic latent image is formed on the insulating member and it is thus possible to greatly enhance the electrostatic contrast provided by the quantity of charge. In addition, it is possible to minimize the attenuation of the charge of the formed latent image and this permits retention copying to be effected more frequently than by the conventional photosensitive medium. In FIG. 5, however, if the polarities of the power sources 13 and 14 are reversed, negative ions will pass through the area corresponding to the light region of the image original, so that a negative image of the original will be formed on the recording medium 15. Also, if a semiconductor such as CdS having electrons as the main carrier is used as the photoconductive member 3 of the screen 1 for the formation of primary electrostatic latent image so that the screen may have such a characteristic that electrons are introduced also in the dark region of the image original, the primary voltage applied must of course be opposite in polarity to that shown above and the voltage applied for the formation of secondary latent image must also be opposite in polarity to that shown above.

Figure 6:
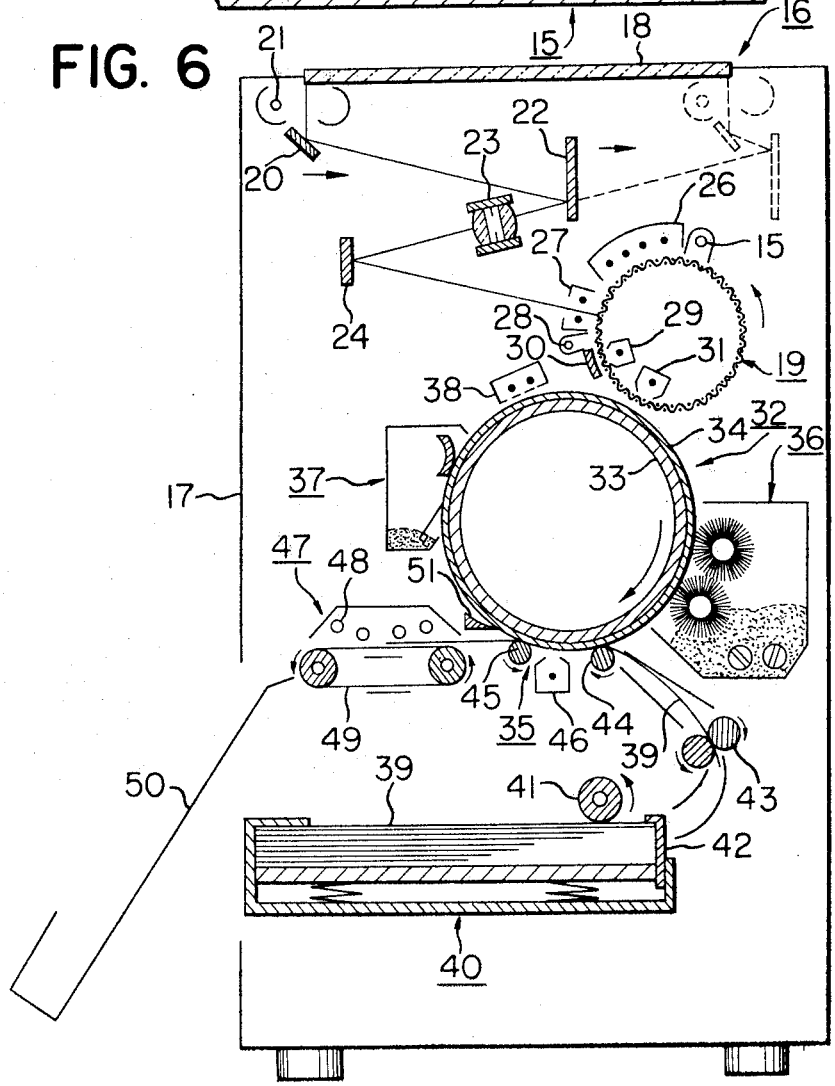
FIG. 6 is a cross-sectional view schematically showing the construction of a conventional apparatus to which the screen of FIG. 1 is applied.

A conventional apparatus using the screen of FIG. 1 will now be described by reference to FIG. 6. The shown example of the image formation apparatus is generally designated as a copying apparatus 16 for forming copy images on plain paper by utilizing the process of latent image formation already explained in conjunction with FIGS. 2 to 5. FIG. 6 schematically shows, in cross-section, the constructions of the various portions of the apparatus. Designated by 17 is the outer housing wall of the apparatus, and an image original such as literature or a document may be placed on an original carriage 18 formed of glass or like transparent material on top of the outer housing wall 17. This original carriage 18 is of the stationary type and the application of image light to the screen 19 constructed as described in connection with FIG. 1 may be done by moving part of the optical means. The optical means is moved by a conventional method, namely, a first mirror 20 and an original illumination lamp 21 are moved at a velocity v from their solid line positions to their rightmost positions indicated by broken lines, over the entire stroke of the original carriage 18. Simultaneously with the movement of the first mirror 20, a second mirror 22 is moved at a velocity v/2 from its solid line position to its rightmost position indicated by broken lines. The image of the original directed by the first 20 and the second mirror 22 is further directed to the screen 19 through a lens system 23 having a diaphragm mechanism and via a stationary mirror 24. The screen 19 is constructed in the form of a drum so that the exposed surface of the conductive member thereof faces inwardly. Adjacent to the screen 19, latent image formation means are disposed along the direction of rotation of the screen 19. A first exposure lamp 25 is provided which ensures that the photoconductive member forming the screen 19 may be used always in a stable state of light history. A corona discharger 26 which is the means for applying a primary voltage may charge the rotating screen 19 up to a sufficient voltage level. A corona discharger 27 which is the means for applying a secondary voltage may remove the charge previously imparted to the screen 19 by the discharger 26 while the image light from the original is thrown therethrough upon the screen. For this purpose, the discharger 27 is designed such that the back shield plate thereof has an optically open construction. A whole surface illumination lamp 28 is provided to uniformly illuminate the screen 19 to rapidly enhance the electrostatic contrast of the primary electrostatic latent image formed thereon. By these means, a primary electrostatic latent image with high electrostatic contrast is formed on the screen 19. A corona discharger 29 disposed within the screen 19 is a regulating corona discharger used to remove any harmful charge sticking to or built up on a modulating corona discharger 31 during retention copying. An electrode 30 is disposed in opposed relationship with the discharger 29, with the screen 19 interposed therebetween, to prevent the primary electrostatic latent image on the screen 19 from being erased during the above-described removal of the harmful charge.

By means of the discharger 31, a secondary electrostatic latent image is formed on an insulating drum 32 which is a recording medium rotatable in the direction of the arrow. The insulating drum 32 comprises a conductive back-up member 33 covered with an insulative layer 34 such as synthetic resin film or the like. A voltage is applied between the conductive back-up member and the conductive member of the screen 19 so that the modulated corona ion flow is directed to the surface of the insulating layer 34. The secondary electrostatic latent image thus formed on the insulative layer 34 is developed into a toner image by well-known developing means 36 of the magnetic brush type or of the cascade type. Thereafter, at an image transfer station 35, the toner image is transferred onto a transfer medium 39 conveyed there in synchronism with the toner image. The insulating drum 32, after passing through the image transfer step, is cleaned by well-known cleaning means 37 to remove any residual toner on the insulative layer 34 thereof, whereafter the insulating drum is charged to a uniform surface potential by a corona discharger 38, thus becoming ready for another copying cycle. The well-known development means mentioned above may be either of the dry type or the wet type, and the cleaning means may be of the blade type, or the brush type or other suitable type. The transfer medium 39 conveyed to the image transfer station 35 comes from a stock piled within a cassette 40. Transfer mediums 39 are separated one by one by means of a feed roller 41 and a separating pawl 42 and conveyed by a set of register rollers 43 in synchronism with the from-time-to-time position of the toner image. Designated by 45 is a conveying roller, and denoted by 46 is an image transfer corona discharger for applying a bias voltage to the transfer medium 39 during transfer of the toner image. After the image transfer, the transfer medium 39 is separated from the insulating drum 32 by a separating pawl 51 and conveyed to fixing means 47. The toner image on the transfer medium 39 is fixed by the heater 48 of the fixing means 47, whereafter the transfer medium is conveyed by a conveyor belt 49 onto a reception tray 50 for finished copies. Where the retention copying is to be effected, only the steps subsequent to the step of secondary electrostatic latent image formation need be repeated. Without being restricted by the charging time and photosensitizing time of the screen or the time of movement of the optical system and thus, high-speed copying becomes possible.

Supposing a case where an n-type photoconductor such as, for example, CdS, is used as the substance forming the photoconductive member of the screen 19 used in the above-described apparatus 16, discussion will now be made about the problems peculiar to the conventional apparatus. In the case supposed above, the screen is charged to the positive polarity during the step of primary voltage application, conversely to what has been described in connection with FIGS. 2 to 4. Therefore, the potential in the dark region of the primary electrostatic latent image assumes the positive polarity and in order that a positive image may be obtained as the secondary electrostatic latent image, the charge applied from the modulating corona discharger 31 must be of the negative polarity (−). Also, as opposed to the conductive back-up member of the screen 19, a voltage of the negative polarity is applied to the conductive back-up member 33 of the insulating drum 32, and the polarity of the toner must be positive in order that positive development may be effected. Thus, the charge from the corona discharger for transferring the toner image from the insulating drum 32 onto the transfer medium 39 must be of the negative polarity. On the other hand, the corona discharger 38 for charging the surface of the insulating drum 32 to a uniform potential should preferably be a discharger having a grid in order that the surface potential of the drum 32 may be uniform at a relatively low level, and the polarity of the discharger 38 must be positive in order to remove the charge imparted by the image transfer discharger 46.

In the apparatus operated with the above-described polarities of charges applied, if the residual toner on the insulating drum should fail to be completely removed by the cleaning means, such toner will be charged to the positive polarity by the discharger 38. Therefore, the residual toner approaching the screen 19 with the rotation of the insulating drum 32 will be subjected to the action of a force which attracts the toner toward the screen 19 due to the electric field resulting from the voltage being applied between the screen 19 and the insulating drum 32, as already noted. By this, part of the toner which is less adhesive to the insulating drum 32 will be moved toward the screen 19 to stick thereto, whereby the screen will be contaminated. Such contamination of the screen by the toner may cause various problems to occur during the image formation. For example, when the image original is illuminated during the step of primary latent image formation, the quantity of light impinging on the screen may be reduced to prevent formation of a primary latent image at a sufficient potential, and this may result in creation of fog in the finished image. Further, if the toner particles stick to the screen so much as to clog the openings of the screen, the modulated ions will no longer be able to sufficiently pass through the openings, thus preventing formation of good secondary electrostatic latent images. This may cause reduced electrostatic contrast of the primary and the secondary electrostatic latent image which may in turn render impossible the formation of a copy image with high contrast, or may extremely reduce the number of times the retention copying can occur. Also, the sticking of the toner to the screen may destroy the primary electrostatic latent image on the screen during the retention copying due to the charge of the toner or the insulation formed by the layer of the sticking toner. In such case, if the retention copying is effected several times, there will occur a phenomenon that the background portion of the formed image becomes black.

In addition to the problem of the toner sticking to the screen, the above-described apparatus may suffer from a problem attributable to the corona discharger 38. More specifically, some of the corona ions generated by the discharger 38 may be caused to drift out to the vicinity of the screen 19 by the wind created by the rotation of the insulating drum 32. Since the electric field is acting between the screen 19 and the insulating drum, as already noted, the ions drifting toward the screen 19 may be attracted to the screen by the negative voltage applied thereto, thus destroying the primary electrostatic latent image formed on the screen.

Such problems are not restricted to the apparatus of the shown embodiment, but are liable to arise from the voltage applied to various members of any apparatus which comprises at least a screen, a recording medium such as insulating drum or the like, developing means, image transfer means, cleaning means and voltage applying means for uniformly charging the surface potential of the recording medium to render the same medium ready for reuse. The present invention offers the following two methods or means to prevent toner or ion flows from sticking to the screen and also to increase the number of times the retention copying can take place, and can further eliminate the need for a cleaning means for the insulating drum.

Figure 7:
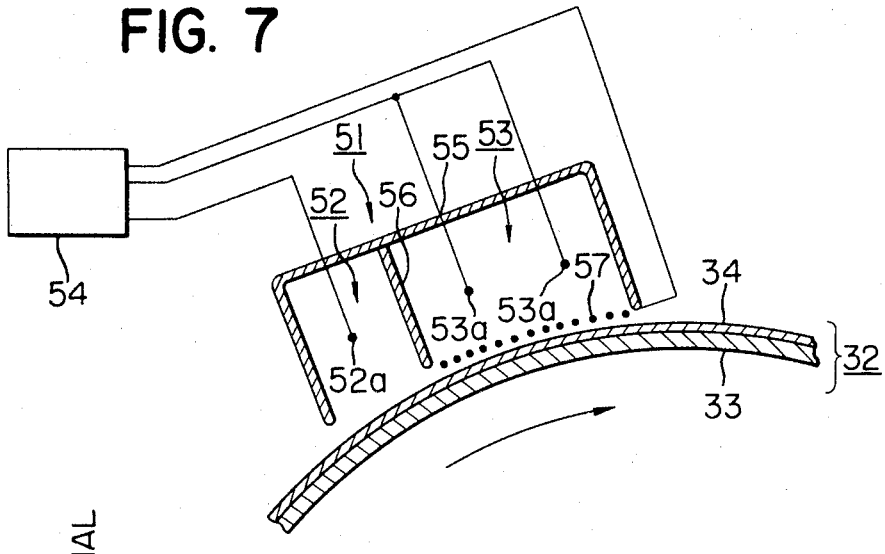
FIG. 7 is a cross-sectional view of an example of the corona discharger embodying a first method or means of the present invention.

A first method or means of the present invention has made it possible to overcome the above-noted problems peculiar to the prior art by improving the corona discharger 38 for the insulating drum 32. FIG. 7 shows, in cross-section, the corona discharger according to an embodiment of the present invention. The discharger 51 of FIG. 7, which replaces the above-described discharger 38, has a first and a second corona discharge chamber arranged in two stages. That is, the discharger 51 has a first corona discharge chamber 52 and a second corona discharge chamber 53, and high voltages of the opposite polarities are applied to the discharge electrodes 52*a* and 53*a* within the respective discharge chambers. Designated by 55 is an outer wall forming the discharger and by this outer wall, the first 52 and the second discharge chamber 53 are formed into a single discharger, the interior of which is separated into the two chambers 52 and 53 by a partition wall 56. These first and second chambers may of course be provided separately from and independently of each other. A grid 57 is provided at that side of the second corona discharge chamber 53 which is adjacent to the insulating drum 32, and the grid 57 is connected to any desired potential source to control the surface potential of the insulating drum 32. In the apparatus of the shown embodiment, the discharge polarities of the corona discharger 51 are such that a voltage of positive polarity is applied to the discharge electrode 52*a* and a voltage of negative polarity is applied to the discharge electrodes 53*a*. The corona discharges generated by the corona discharge electrodes 52*a* and 53*a* need only be substantially opposite in polarity and therefore, an AC voltage with a bias voltage superimposed thereon is also available as the voltage to be applied. Since the polarity of the corona ions finally received in the discharger 51 is negative, the residual toner after having passed by the discharger 51 is of course charged to the negative polarity not only when the surface potential of the insulating drum 32 is of the negative sign, but also when the surface potential of the insulating drum 32 is of the positive sign. Thus, even when the residual toner approaches the screen 19, the residual toner is subjected to a force directed toward the insulative member by the electric field present between the screen 19 and the insulating drum 32, as already noted, so that the residual toner never moves toward the screen. Also, the positive ions drifting out of the corona discharge chamber 52 which act to render the surface of the insulating drum 32 to the positive potential completely disappear in the next or second corona discharge chamber 53. By this, the corona ions drifting out of the discharger 51 are rendered into negative (−) ions which never move toward the screen. This also makes it possible to prevent the destruction or attenuation of the primary electrostatic latent image by ions which has heretofore been a problem. However, in the subsequent step of development, the residual toner charged to the negative polarity is again taken into the developer if the developing means used is of the type which permits recycling of the toner, such as the cascade type or the magnetic brush type. Therefore, there is little or no fear that the residual toner should appear in the copy image to adversely affect the finished copy image. This means that if a toner having a good efficiency of transfer is employed, there will be no need to use cleaning means. In fact, in the apparatus of the shown embodiment, the corona discharger 38 of FIG. 6 has been replaced by the corona discharger 51 of FIG. 7 and the cleaning means has been eliminated and when image formation has been effected by such apparatus, it has been found that the influence of an earlier image upon a next image is practically inappreciable. In FIG. 7, reference numeral 54 designates a power source section for the discharger 51.

Figure 8:
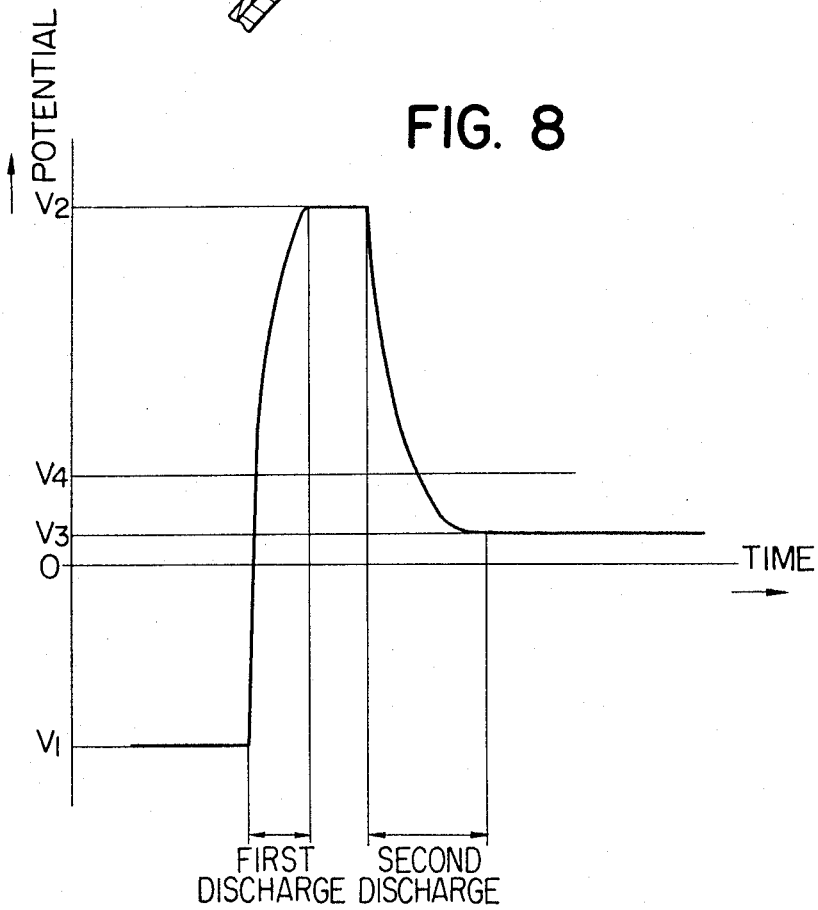
FIG. 8 is a graph illustrating a variation in potential curve which represents the variation in the potential on the insulating drum adjacent to the corona discharger of FIG. 7.

When the region of the secondary electrostatic latent image corresponding to the dark region of the image original is of the negative polarity, the fogging due to development may be more conveniently prevented by imparting a positive polarity to the light region of the latent image. When the above-mentioned dark region is of negative polarity and if the secondary electrostatic latent image is formed with the light region thereof being at zero or negative potential, then a bias voltage will have to be applied to the developing means to prevent the fogging and this will in turn require the developing means to be disposed in insulated relationship with the apparatus body, thus complicating the mounting of the developing means. According to the present invention, however, it is also possible to control the polarities of the secondary electrostatic latent image so that the regions thereof corresponding to the dark and the light region of the image original are opposite in polarity so as to provide a good copy image with the developing means kept in a grounded state. More specifically, this may be accomplished by applying, to the grid 57 of the corona discharger 51, a voltage opposite in polarity to the voltage applied to the corona discharge electrodes 53*a*. In this case, the potential on the insulating drum 32 is varied as indicated by the potential curve shown in FIG. 8, wherein the ordinate represents the potential with the abscissa representing time, so that the curve represents the surface potential of the insulating drum 32 in the portion thereof adjacent to the corona discharger 51. Here again, description will be made by taking as an example a case where the screen is one using CdS. As seen there, when modulated ions were of the negative sign, the surface potential of the insulating drum 32 was rendered to a potential level $V_1$ by the image transfer corona discharger 46 after the image transfer to the transfer medium, and this surface potential $V_1$ is first varied to a potential $V_2$ of the positive sign by the insulating drum being subjected to the positive corona discharge from the discharge electrode 52*a* at the first corona discharge chamber. Subsequently, at the second corona discharge chamber the insulating drum 32 is subjected to a negative corona discharge from the discharge electrodes 53*a* so that the potential $V_2$ is varied to a lower background potential $V_3$ which is suitable for development. This may be accomplished by applying to the grid 57 a voltage $V_4$ which is closer to $V_2$ than to $V_3$. The potential $V_3$ is determined by such factors as the developer of the developing means and is usually of the order of 0 to 100 volts, and the difference between $V_4$ and $V_3$ is determined by the shape and location of the grid 57.

By doing so, in spite of the fact that the surface potential of the insulating drum 32 after having passed through the corona discharger 51 is of the positive polarity, the charge of the residual toner on the drum 32 is intensely affected by the corona discharge of the negative polarity to which the drum 32 is subjected for the last time, thus assuming the negative polarity or a value approximate to zero. It is of course possible to use the corona discharger 38 of FIG. 6, instead of the corona discharger 51 of FIG. 7, to generate a corona discharge of the positive polarity and vary the potential directly from $V_1$ to $V_3$, but the residual toner in such case seems to be so intensely charged to the positive polarity that the toner particles will jump and stick to the screen 19 and contaminate the same.

EXAMPLE

When $V_1$ was −200 V, a voltage of +7 KV was applied to the discharge electrode 52*a* of the corona discharger 51, whereby the potential of $V_2$ became +300 V. In that case, the grid 57 of the corona discharger 51 was formed by stretching tungsten filaments of 0.1 mm diameter at intervals of 1 mm and was installed at a distance of 1 mm from the surface of the insulating drum 32. A voltage of +200 V was applied to the grid 57 and a voltage of −8 KV was applied to the discharge electrode 53*a*. $V_3$ became +60 V and thus, there was obtained an optimum condition to provide a fogless, clear image.

Figure 9:
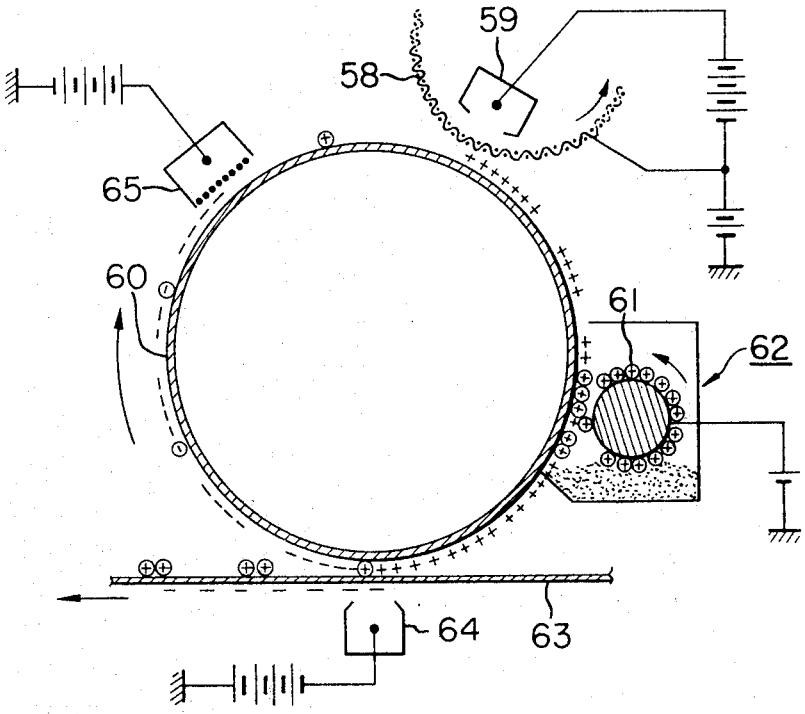
FIG. 9 is a cross-sectional view schematically showing portions of an image formation apparatus embodying a second method or means of the present invention.

Instead of the above-described first method or means of the present invention, the method of reversal development may be adopted as a second method or means. In order that a positive image may be obtained by using the method of reversal development, it will suffice to form a reversal image at the stage of secondary electrostatic latent image formation. This will hereinafter be explained by reference to FIG. 9. Designated by 58 is a screen of the same construction as that described in connection with FIGS. 1 and 6. FIG. 9 schematically illustrates the polarities of the charges, and explanation will be made by taking as an example the case where the screen 58 uses CdS for the photoconductive member thereof as in the example described above. In this case, if the polarity of the corona discharger 59 for generating the corona ion flows to be modulated is positive, a field through which the positive ions pass will act in the region corresponding to the light region of the image original while a field blocking the positive ions will act in the region corresponding to the dark region of the image original. Thus, in that portion of the insulating drum surface 60 corresponding to the light region of the image original, there will be formed a secondary electrostatic latent image which comprises positive ions but is a negative of the image original. When the reversal development is effected on the secondary electrostatic image by developing means 62 with the aid of toner 61 charged to the positive polarity, such toner will stick to the region corresponding to the dark region of the image original, thus enabling the secondary latent image to be developed into a positive image.

Thereafter, the transfer of the toner image to transfer medium 63 may be accomplished by the use of a negative corona discharge from corona discharger 64, and the removal of the charge from the insulating drum 60 may be done by the use of the positive corona discharge from corona discharger 65. When image formation is effected with the above-described construction, any residual toner after having passed by the corona discharger 65 for discharging the insulating drum will assume the positive polarity and thus, such toner will never be electrostatically attracted by the screen 58 having a positive voltage applied thereto, so that the toner will never contaminate the screen 58. The apparatus is shown as one which uses no cleaning means, but it will of course be possible to add cleaning means to remove the residual toner more completely after the image transfer.

The present invention, as has hitherto been described, enables the residual developer on the recording medium after the image transfer to be charged to polarity of such sense that the developer is subjected to a force directed toward the recording medium by the electric field present between the screen and the recording medium, thereby rendering the recording medium available for reuse. By this, scattering of the residual toner to the screen can be prevented and accordingly, the various problems which have heretofore been attributable to such scattered toner can be solved. Also, where use is made of the two-stage corona discharger as shown in the embodiment of FIG. 7, not only the scattering of the toner but also the adverse effect imparted to the primary electrostatic latent image on the screen by the corona ions drifting out of the corona discharger for discharging may be prevented. If the residual toner is very small in quantity, such residual toner may be again collected into the developer by the developing means, so that during the copying of ordinary documents, an earlier formed image rarely affects the next formed image and this leads to the possibility of eliminating the cleaning means. If the cleaning means could be eliminated, the manufacturing cost would be lowered and the internal space therefor could be effectively utilized to reduce the size of the apparatus or to perfect other constituents. Further, the two-stage corona discharger 51 of FIG. 7 is shown as a unitary construction, whereas it may be divided into a plurality of individual dischargers or the first of them may be used also as the corona discharger for sufficiently removing the toner from the recording medium in the cleaning station. In other words, this may be accomplished by designing the first discharger such that the recording medium is not charged nor discharged to a predetermined potential at a single stroke but can be finally charged to the polarity to which the toner particles are to be finally charged.

The second method or means of the present invention has been shown as the method of obtaining a positive image from a negative latent image through the reversal development, and this may be instrumented by arranging various processing means around the recording medium in the same manner as with the conventional apparatus, namely, arranging around the recording medium the toner image transfer means, (the step of cleaning), the corona discharger for rendering uniform the surface potential of the insulating drum, etc. in the named order. In this case, however, an AC voltage should not simply be applied to the last corona discharger to render it to the zero potential but the residual toner should preferably be somewhat charged so that a force directed toward the recording medium acts on the residual toner between the screen and the recording medium.

In the foregoing, the screen has been shown as a three-layer construction, whereas this is not restrictive but the invention is equally applicable, for example, to the conventional two-layer or three-layer or other multi-layer screen. In other words, any screen may used which has the function of modulating a flow of ions to form into the form of an image. Also, in the shown embodiment, the insulating drum has been shown as a drum of two-layer construction, whereas the drum shape is not restrictive but any other suitable shape such as a web or sheet which may be repetitively used for the formation of secondary electrostatic latent image is available. Further, the present invention effectively acts on not only the toner on the recording medium, but also the paper powder or fiber structure of the transfer paper brought into contact with the recording medium during the image transfer, or other kinds of dust sticking to the transfer medium, thereby preventing the screen from being contaminated by these foreign substances.

What we claim is:

1. A method of image formation comprising the steps of forming a primary electrostatic latent image on a photosensitive screen having a number of fine openings, using said primary electrostatic latent image to modulate a flow of ions to form a secondary electrostatic latent image on a repetitively usable recording medium under an electric field provided by a bias potential difference between the screen and the recording medium adjacent to a position at which the screen and the recording medium are close to each other, developing said secondary electrostatic latent image by means of a developer, transferring the developed image to a transfer member, applying a charge of the same polarity as that of the ions used to form the secondary latent image to the residual developer remaining on said recording medium after said image transfer such that said residual developer is subjected to a force directed toward said recording medium under said electric field to thereby prevent said residual developer from adhering to said screen, and thereafter moving said recording medium to a position for the formation of another secondary latent image.

2. A method according to claim 1, wherein said step of charging said residual developer remaining on said recording medium after the image transfer comprises uniformly imparting corona discharges of different polarities to said recording medium in succession.

3. A method according to claim 2, wherein the step of uniformly imparting corona discharges of different polarities is effected by a combination of DC corona dischargers of different polarities.

4. A method according to claim 2, wherein the step of uniformly imparting corona discharges of different polarities is effected by a combination of a DC corona discharger and an AC corona discharger which is biased with DC corona.

5. A method according to claim 2, wherein the uniform imparting of corona discharges is performed with a corona discharger having first and second discharge devices, wherein said first corona discharger device imparts corona discharge of a first polarity to said recording medium and said second corona discharger device imparts corona discharge of a second polarity to said recording medium, and after having passed by said second corona discharger device, the surface potential of said recording medium is of the second polarity.

6. a method according to claim 2, wherein the uniform imparting of corona discharges is performed with a corona discharger having first and second discharge devices, wherein said first corona discharger device imparts corona discharge of a first polarity to said recording medium, wherein said second corona discharger device includes a discharge electrode which applies a voltage of a second polarity to said recording medium and a grid to which is applied a voltage opposite in polarity to the voltage applied to said discharge electrode.

7. A method according to claim 1, wherein said recording medium is reusable without the provision of cleaning means for removing the residual developer on said recording medium.

8. A method according to claim 1, wherein said secondary electrostatic latent image is positively developed.

9. A method of image formation comprising the steps of forming a primary electrostatic latent image of a photosensitive screen having a number of fine openings, using said primary electrostatic latent image to modulate a flow of ions to form a secondary electrostatic image on a repetitively usable recording medium under an electric field provided by a bias potential difference between the screen and the recording medium adjacent to a position at which the screen and the recording medium come close to each other, developing said recording medium with a developer in accordance with said secondary electrostatic latent image, transferring the developed image to a transfer member, applying a charge of the same polarity as that of the ions used to form the secondary latent image to the residual developer remaining on said recording medium after transfer such that the residual developer is subjected to a force directed toward said recording medium under said electric field to thereby prevent said residual developer from adhering to said screen, and thereafter reusing said recording medium to form a plurality of additional secondary electrostatic latent images from said primary electrostatic latent image, and developing and transferring said plurality of additional images.

10. A method of image formation comprising the steps of forming a primary electrostatic latent image on a photosenstive screen having a number of fine openings, using said primary electrostatic latent image to modulate a flow of ions to form a secondary electrostatic latent image on a repetitively usable recording medium under an electric field provided by a bias potential difference between the screen and the recording medium adjacent to a position at which the screen and the recording medium come close to each other, reverse-developing said secondary electrostatic latent image with a developer, transferring the developed image to a transfer member, applying a charge of the same polarity as that of the ions used to form the secondary latent image to the residual developer remaining on said recording medium after transfer such that the residual developer is subjected to a force directed toward said recording medium under said electric field to thereby prevent said residual developer from adhering to said screen, and thereafter moving said recording medium to a position for the formation of another secondary latent image.

11. A method according to claim 10, wherein said recording medium is reusable without the provision of cleaning means for removing the residual developer on said recording medium.

12. A method of image formation comprising the steps of forming a primary electrostatic latent image on a photosensitive screen having a number of fine openings; using said primary electrostatic latent image to modulate a flow of ions to thereby form a secondary electrostatic latent image on a recording medium, developing said secondary electrostatic latent image with a developer, wherein before modulation of the flow of ions, said recording medium is uniformly charged to a polarity opposite to that of said ions to form a secondary latent image having a first polarity of electric charge at the dark areas of the image and the opposite polarity of electric charge at the light areas thereof.

13. A method according to claim 12, wherein said recording medium is charged with a corona discharger before the modulation of the flow of ions.

14. A method according to claim 13, wherein said corona discharger is provided with a grid.

15. A method according to claim 12, wherein said recording medium is charged with sequential corona discharges of different polarities, before the modulation of the flow of ions.

* * * * *

UNITED STATES PATENT AND TRADEMARK OFFICE

CERTIFICATE OF CORRECTION

PATENT NO. : 4,248,951

DATED : February 3, 1981

INVENTOR(S) : Yujiro Ando, et al.

It is certified that error appears in the above-identified patent and that said Letters Patent is hereby corrected as shown below:

Column 1, line 59, delete "into a form of image";

Column 2, line 27, "one" should read -- once --;

line 34, "chacteristics" should read -- characteristics --;

Column 3, line 2, delete "a";

Column 4, line 65, "charges" should read -- changes --;

Column 6, line 64, "development" should read -- developing --;

Column 11, line 46, insert -- a -- between "to" and "polarity";

Column 12, line 36, delete "into the form of";

Signed and Sealed this

Sixteenth Day of August 1983

[SEAL]

Attest:

GERALD J. MOSSINGHOFF

Attesting Officer

Commissioner of Patents and Trademarks